US006206499B1

(12) United States Patent
Iijima et al.

(10) Patent No.: US 6,206,499 B1
(45) Date of Patent: Mar. 27, 2001

(54) INK-JET RECORDING HEAD

(75) Inventors: Takayuki Iijima; Koji Morikoshi, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/420,587

(22) Filed: Oct. 19, 1999

(30) Foreign Application Priority Data

Oct. 19, 1998 (JP) ..... 10-297417
Jan. 29, 1999 (JP) ..... 11-022500

(51) Int. Cl.[7] ..... B41J 2/165
(52) U.S. Cl. ..... 347/33; 347/20; 347/68
(58) Field of Search ..... 347/33, 47, 44, 347/49, 68, 70, 71, 20

(56) References Cited

U.S. PATENT DOCUMENTS 5,534,898 7/1996 Kashino et al. ..... 347/33
5,539,435 * 7/1996 Uchida et al. ..... 347/33
5,956,058 * 9/1999 Momose et al. ..... 347/71
6,027,208 2/2000 Amano ..... 347/70

FOREIGN PATENT DOCUMENTS 790129 8/1997 (EP) .
861725 9/1998 (EP) .

OTHER PUBLICATIONS

Patent Abstracts of Japan, vol. 1997, No. 9, Sep. 30, 1997 (JP 09–123463).

* cited by examiner

*Primary Examiner*—N. Le
*Assistant Examiner*—Shih-wen Hsieh
(74) *Attorney, Agent, or Firm*—Sughrue, Mion, Zinn, Macpeak & Seas, PLLC

(57) ABSTRACT

An inkjet recording head including a head cover for protecting the recording head. The head cover includes a notch formed at a top portion thereof which exposes a side portion of the nozzle plate of the ink-jet recording head so that a wiping blade can effectively wipe a top surface of a nozzle plate without interference by the head cover.

27 Claims, 14 Drawing Sheets

INK-JET RECORDING HEAD

BACKGROUND OF THE INVENTION

The present invention relates to an ink-jet recording head for ejecting ink droplets through nozzle orifices to record images or characters on a recording sheet, and in particular to the structure of a head cover for protecting a recording head.

As is shown in FIG. 14, an ink-jet recording apparatus 1 is so designed that a carriage 3 is movably attached to a guide member 2 and is connected to a timing belt 6 that is wrapped around a drive pulley 4 and a follow-up pulley 5 and that a pulse motor 7 reciprocally moves the carriage 3 in the direction of the width of a recording sheet 8 (main scanning).

A recording head 9 is located on the face of the carriage 3 opposite the recording sheet 8, or on the bottom face in this example. During the main scanning, ink supplied from an ink cartridge 10 is ejected as ink droplets to the recording sheet 8 to record characters and images thereon.

As is shown in FIG. 15, for the recording head 9, a channel unit 16 is constituted by laminating a nozzle plate, in which a plurality of arrays of a plurality of nozzle orifices 11 are formed, a channel forming substrate 14, in which a plurality of pressure generating chambers corresponding to the nozzle orifices 11 and an ink supply chamber are formed, and an elastic sheet 15, which transmits the vibration of piezoelectric vibrators 12 to change the volume of the pressure generating chambers. The channel unit 16 is bonded on the surface of a casing 17 with an adhesive, and the distal ends of the piezoelectric vibrators 12 are brought into contact with the elastic sheet 15 and are securely retained in the casing 17.

The channel unit 16 is fixed to the casing 17 by a conductive head cover 19 in which a window is formed to expose the nozzle orifices 11, so that the nozzle plate 13 can be prevented from being damaged due to paper stacking, and electric charge can be prevented.

When one part of ink in ink droplets ejected from the nozzle orifices 11 remains on the surface of the nozzle plate 13, this ink may be mixed with ink for the other nozzle arrays, or may change the direction in which ink droplets are dispersed and may deteriorate the printing quality.

In order to wipe ink that remains on the nozzle plate 13, as is shown in FIG. 14, a wiper plate 20 that can ascend and descend on the nozzle face is provided at the location outside the recording available range. When the wiper blade 20 is elevated as needed and is brought in contact with the nozzle plate 13 and when the carriage 3 is reciprocally moved in this condition, the ink remaining on the nozzle plate 13 is wiped away by the wiper blade 20, and the printing quality is recovered.

However, since the external circumference of the recording head 9 is covered with the head cover 19, a wiper blade 20 that is longer than the width of the recording head 9 is elastically deformed by application of a specific force and contacts the nozzle plate 13. If a specific force is not applied, the wiper blade floats in contact with the head cover 19 on the nozzle plate, and does not contact the face of the nozzle plate. Thus, the ink remaining in an area close to the head cover 19 can not be completely wiped.

SUMMARY OF THE INVENTION

To resolve this problem, it is one objective of the present invention provide an ink-jet recording head that can completely remove ink remaining in an area where nozzle orifices are formed.

To achieve the above objective, according to the present invention, there is provided an ink-jet recording head comprising:

- a casing;
- a nozzle plate provided on the casing and having a plurality of nozzle orifices formed therein;
- a channel unit provided between the nozzle plate and casing for ejecting ink drops from the nozzle orifices by use of pressure generating means;
- a head cover for covering side faces of the casing and edge portions of a top face of the nozzle plate and for defining a wiping space for which the surface of the nozzle plate is wiped by a wiper, the wiping space situated lower than the top face of the nozzle plate.

At least in the nozzle forming area, the wiper blade is uniformly brought in contact with the nozzle plate without being disturbed by the head cover, and the wiper blade scrapes residual ink under uniform pressure.

DETAILED DESCRIPTION OF THE PREFERRED EMBODIMENTS

The details of the present invention will now be described by employing the illustrated embodiments.

Figure 1:
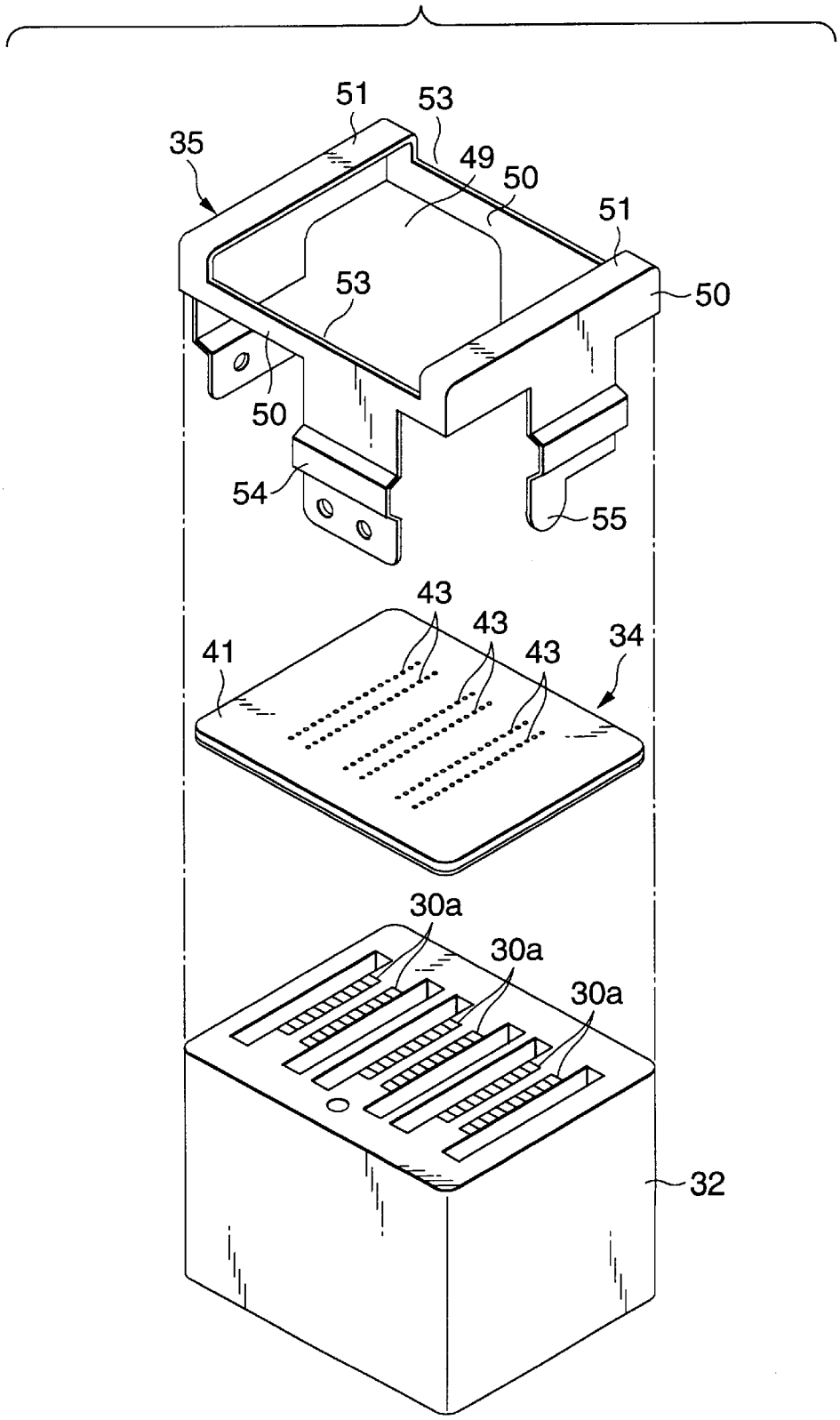
FIG. 1 is an exploded perspective view of a recording head according to a first embodiment of the present invention.
Figure 2:
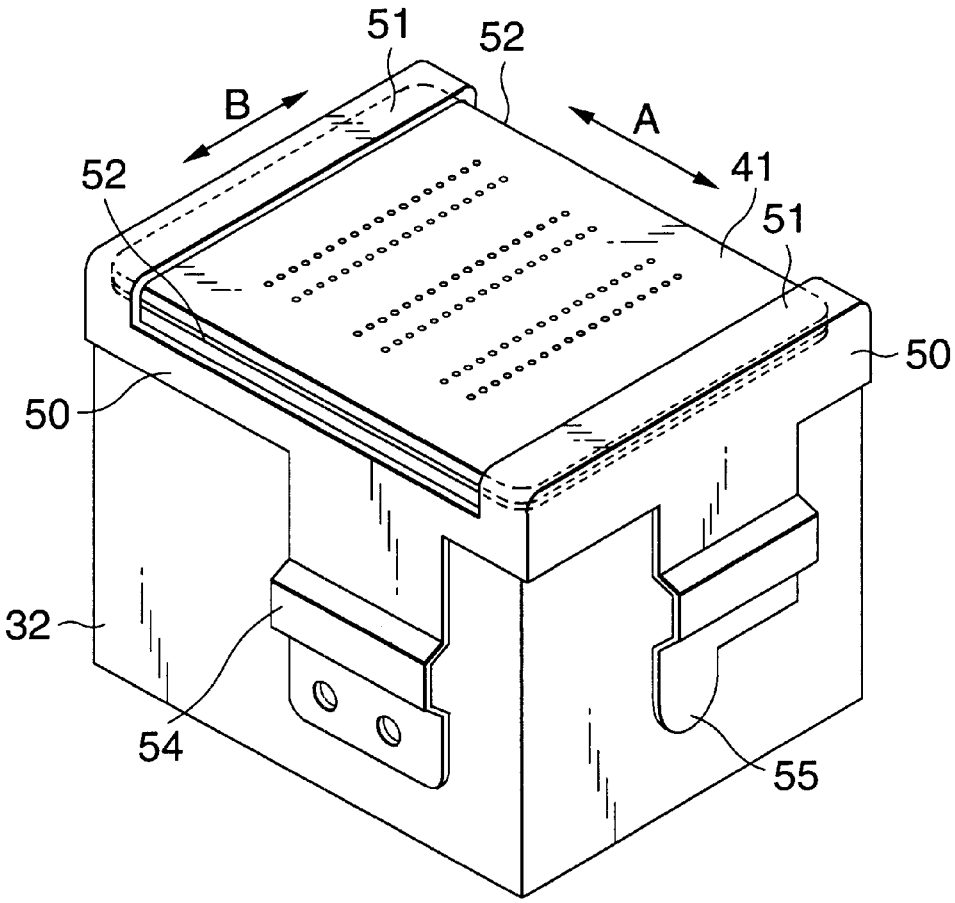
FIG. 2 is a perspective view of the recording head of FIG. 1.
Figure 3:
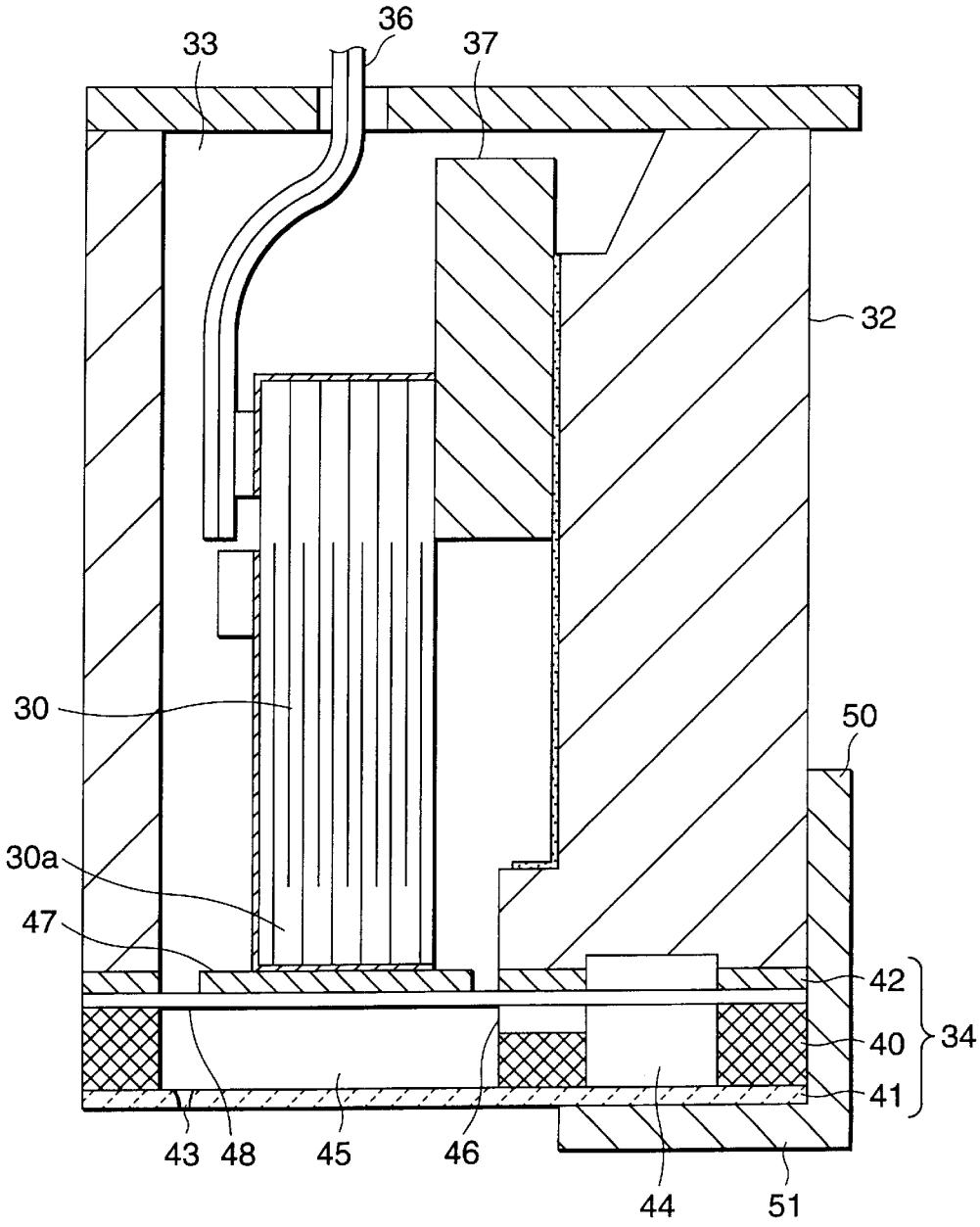
FIG. 3 is a cross-sectional view of the vicinity of a pressure generating chamber of the recording head of FIG. 1.

In FIGS. 1, 2 and 3 is shown an ink-jet recording head 31 that employs piezoelectric vibrators 30 as a pressure generating member according to a first embodiment. FIG. 1 is an exploded perspective view, FIG. 2 is a perspective view of the entire structure, and FIG. 3 is an enlarged cross-sectional view of the vicinity of a pressure generating chamber.

The recording head 31 is designed as follows: the piezoelectric vibrators 30 are inserted from one opening of a chamber 33 of a box-shaped head casing 32 that is formed of, for example, plastic and comb-like distal ends 30*a* are exposed to the other opening; a channel unit 34 is bonded to the surface of the head casing close to the opening (bottom face) of the casing 32, and the comb-like ends 30*a* of the piezoelectric vibrators 30 are fixed to predetermined positions of the channel unit 34; and a head cover 35 is fixed to the surface of the channel unit 34. Reference numeral 36 denotes a flexible cable and 37 denotes a fixation base.

The channel unit 34 is constituted by laminating a nozzle plate 41 and an elastic sheet 42 with a channel forming substrate 40 in between. A plurality of nozzle orifices 43 are formed as an array at pitches that correspond to the dot formation density, and a plurality of such arrays are arranged in the nozzle plate 41.

The channel forming substrate 40 is a plate member in which a long common ink reservoir 44 defined by partition walls, a plurality of pressure generating chambers 45 that communicate with the nozzle orifices 43, and an ink supply port 46, along which the common ink reservoir 44 communicates with the individual pressure generating chambers 45, are formed.

The ink supply port 46 is connected to one end of the pressure generating chamber 45, and the nozzle orifices 43 of the nozzle plate 41 are formed so that they are located in the vicinity of the end of the pressure generating chamber 45 opposite the ink supply port 46. An ink supply pipe is formed at the end of the common ink reservoir 44 and serves as a channel along which ink retained in an ink cartridge is supplied to the common ink reservoir 44.

In this embodiment, the elastic sheet 42 serves as a sealing plate, which is laminated on the face of the channel forming substrate 40 opposite the nozzle plate 41 to seal at least one opening of the pressure generating chamber 45, and also as an elastic film, which is laminated on that face of the channel forming substrate 40 to seal at least one opening of the common ink reservoir 44. And the elastic sheet 42 has a double structure where a stainless steel plate and a polymer film, such as PPS, that serves as an elastic film are laminated. Since the same member is used as the sealing plate and the elastic film, the stainless steel portion that functions as the sealing plate, i.e., a portion that corresponds to the pressure generating chamber 45, is etched to form a thick wall portion (island portion) 47 for fixing the piezoelectric vibrators 30. Further, the portion of the stainless steel plate that functions as the elastic film, i.e., the portion that corresponds to the common ink reservoir 44, is removed by etching to expose an elastic film 48.

To form the channel unit 34 by laminating the nozzle plate 41, the channel forming substrate 40 and the elastic sheet 42, the nozzle plate 41 is bonded to one face of the channel forming substrate 40 so that the small-diameter side of the nozzle orifices 43 faces outside, and the elastic sheet 42 is bonded to the other face of the channel forming substrate 40, so that the stainless steel plate is located on the side of said elastic sheet not in contact with said channel forming substrate.

Thus, the opening faces of the individual pressure generating chambers 45 and the common ink reservoir 44 of the channel forming substrate 40 are sealed by the elastic film, the opening in the top of the groove-shaped ink supply port 46 is covered with the elastic film, and the other opening faces of the pressure generating chambers 45 and the common ink reservoir 44 are closed by the nozzle plate 41.

The head cover 35 for protecting the channel unit 34 is formed by pressing a conductive metal plate, so that the head cover 35 is a frame member having a window 49 from which all the nozzle orifices 43 of the nozzle plate 41 are exposed when the head cover 35 is attached. The head cover 35 includes four side walls 50 that contact the respective sides of the casing 32. An overlapping portion 51, which is bent approximately 90 degrees from the distal edge of the respective side walls 50 to the surface of the nozzle plate 41, is formed along shorter side walls 50 that extend parallel to the arrangement direction of the nozzle orifice arrays of the nozzle plate 41 when the nozzle plate 41 is attached to the casing 32, i.e., in direction B perpendicular to relative wiping direction A of the wiper blade 20.

Figure 4:
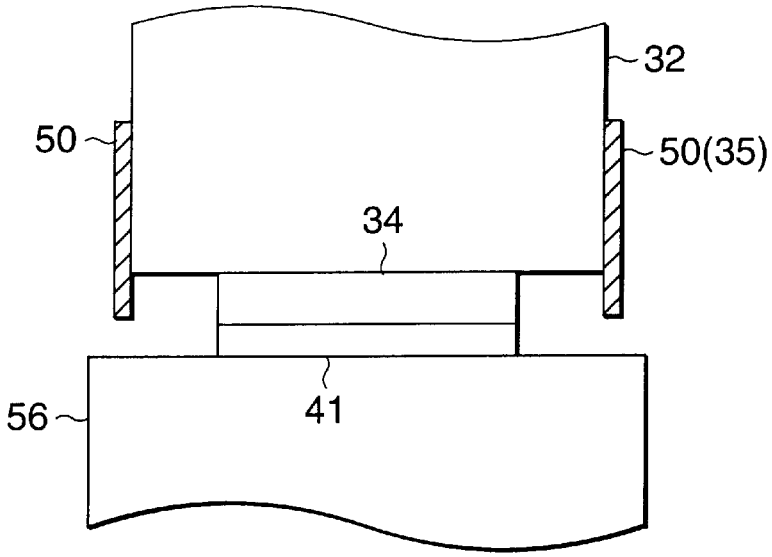
FIG. 4 is a cross-sectional view of a head cover of FIG. 1 viewed from the front of a wiper blade.

A notch 53 is formed along the longer side walls 50 that extend in the wiping direction A to ensure that the wiper blade 56 can contact the top face of the nozzle plate 41 without interference by the head cover (see FIG. 4). Both ends of the longer side walls remain to form the overlapping portions 51. An attachment piece 54 extends from the notch 53 to the side wall 50, and a conductive piece 55 extends from the side wall 50.

The size of the internal face of a quadrilateral defined by the four side walls 50 is adjusted in accordance with the size of the head casing 32, so that the head cover 35 is not loose when it is attached to the head casing 32.

To fit the head cover 35 over the head casing 32, as is shown in FIG. 2, the attachment piece 54 is brought into contact with the longer side walls of the casing, and the conductive piece 55 is brought into contact with the shorter side walls, so that the head cover 35 is connected to the ground line of the casing 32 through the conductive piece 55. It should be noted that the head cover 35 is fixed to the head casing 32 by screwing, bonding or staking.

When the head cover 35 is fixed to the head casing 32, the overlapping portions 51 hold the four corners of the channel unit 34, and cover both side edges that extend in a direction parallel to the arrangement direction of the nozzle orifice arrays in the nozzle plate 41. Further, the notches 53 in the side walls 50 are positioned next to the side edges of the nozzle plate 41 that extend in a direction perpendicular to the arrangement direction of the nozzle orifice arrays, i.e., perpendicular to the wiping direction A, and the nozzle plate 41 is exposed.

Therefore, when the carriage 3 is moved to remove ink from the surface of the recording head 31 by using the wiper blade 56, as is shown in FIG. 4, the wiper blade 56 that is even longer than the width of the nozzle plate 41 contacts the overall width of the nozzle plate 41 in the area where the nozzle orifices 43 are located, so that the ink in the vicinity of the nozzle orifices 43 can be completely removed without the wiper blade 56 floating above the top surface of the nozzle plate 41.

Figure 5:
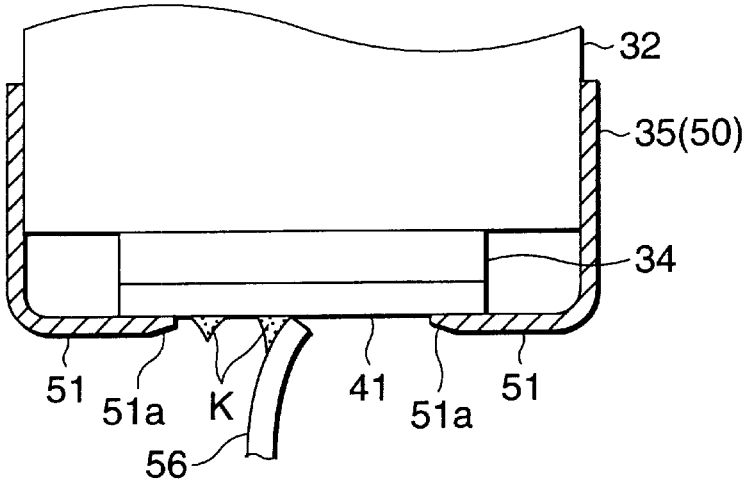
FIG. 5 is a cross-sectional view of the head cover of FIG. 1 viewed from the side of the wiper blade.

As is shown in FIG. 5, since a tapered slope 51 a is formed at the side edges of the head cover 35 that cover the side edges of the nozzle plate 41, i.e., at the distal edges of the overlapping portions 51, ink K attached to the wiper blade 56 is discharged from the head cover 35 across the overlapping portion 51, without being scraped at the overlapping portions 51 and without causing ink splash from the wiper blade 56, and dispersion of ink when ink is discharged across the overlapping portion 51 can be prevented.

When a paper jamming occurs in the recording area, due to the overlapping portions 51 of the head cover 35 a clearance can be obtained with the recording sheet, and external force from the recording sheet that is accompanied by scanning of the recording head can be prevented from acting on the channel unit 34.

In this embodiment, cleaning is performed by moving the recording head 31 relative to the wiper blade 20. However, the same effect can be obtained by moving the wiper blade 20.

Figure 6:
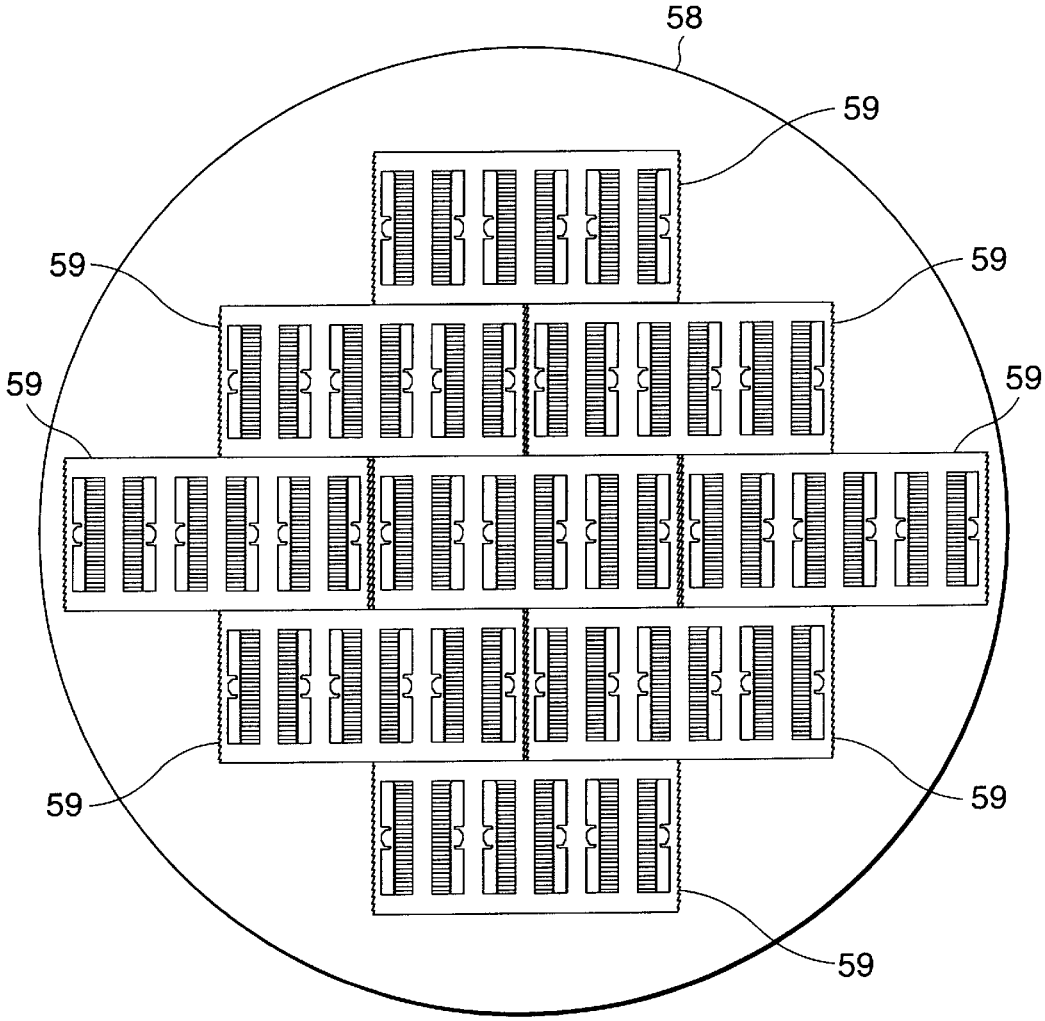
FIG. 6 is a diagram illustrating an example monocrystalline silicon wafer in which a plurality of channel forming substrates are formed.

In an ink-jet recording head where nozzle orifices are arranged at a high density, recessed portions or through holes for forming channels must be precisely formed and the rigidity must be obtained. Thus, a large monocrystalline silicon substrate 58 shown in FIG. 6 is employed to form a plurality of channel forming substrates 59 by anisotropic etching. In order to simplify handling in the etching process, when the etching is terminated, the individual channel forming substrates are connected together by small pieces 60, and at the final step, the substrates are then separated thereat.

Figure 7:
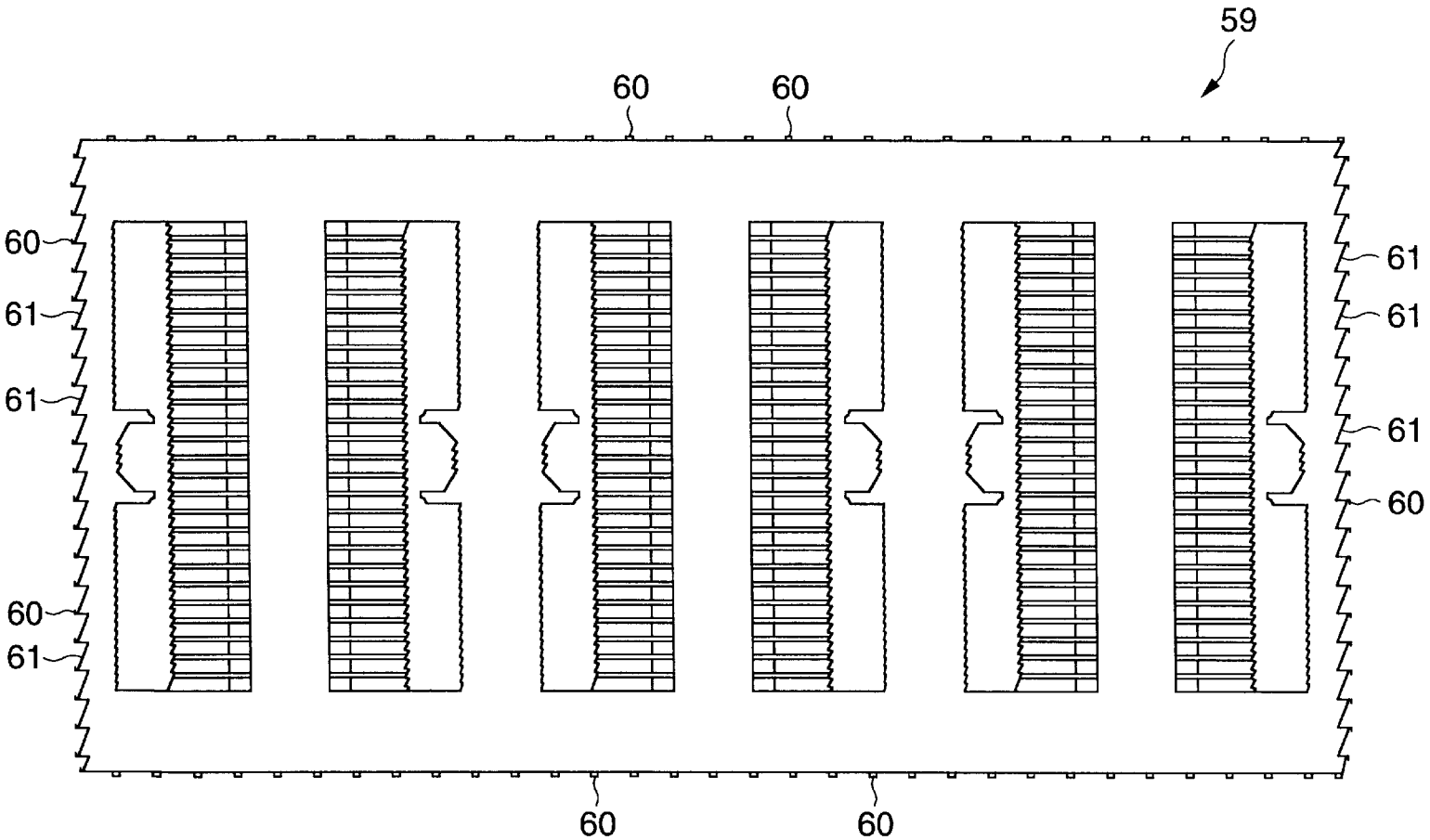
FIG. 7 is a diagram illustrating an example channel forming substrate fabricated using the monocrystalline silicon wafer of FIG. 6.
Figure 8A:
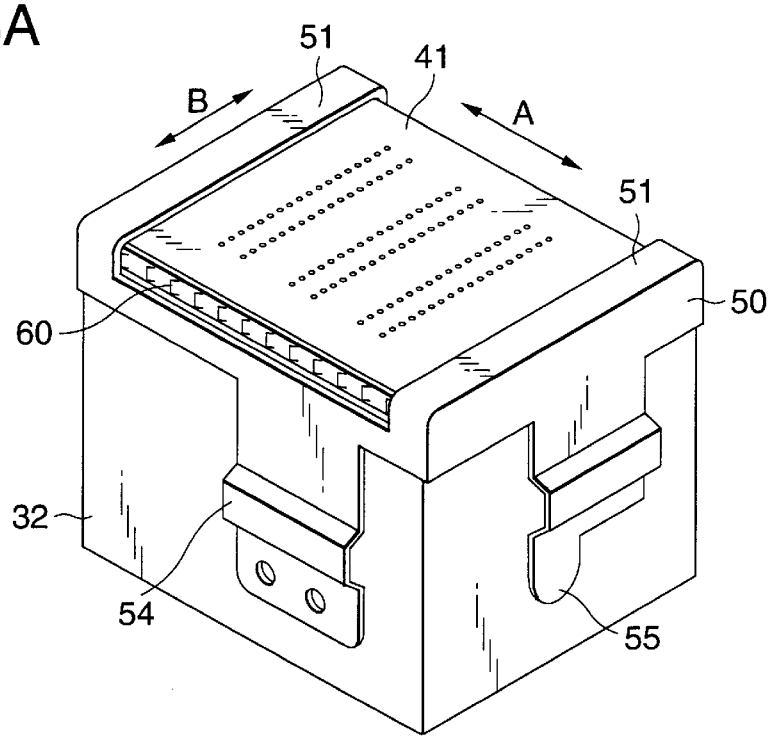
FIGS. 8A and 8B are diagrams illustrating example recording heads constituted by using the channel forming substrate of FIG. 7.

As well known, since the anisotropic etching direction is limited to a predetermined direction relative to the crystal face, small saw-like portions 61 shown in FIG. 7 are present on the face along the arrangement of the pressure generating chambers. When the channel forming substrate 59 is assembled to form the recording head, as is shown in FIG. 8A, the roughness is present in direction B perpendicular to direction A in which the wiper blade 56 is moved. However, since the pertinent portions are covered with the overlapping portions of the head cover 35, the wiper blade 56 is not damaged and cleaning is not adversely affected.

Whereas, the rough portions due to the small pieces 60 are exposed on the face in the direction A in which the wiper blade 56 is moved, and the area of the wiper blade 56 that contacts the ends of the recording head is worn quickly.

Figure 8B:
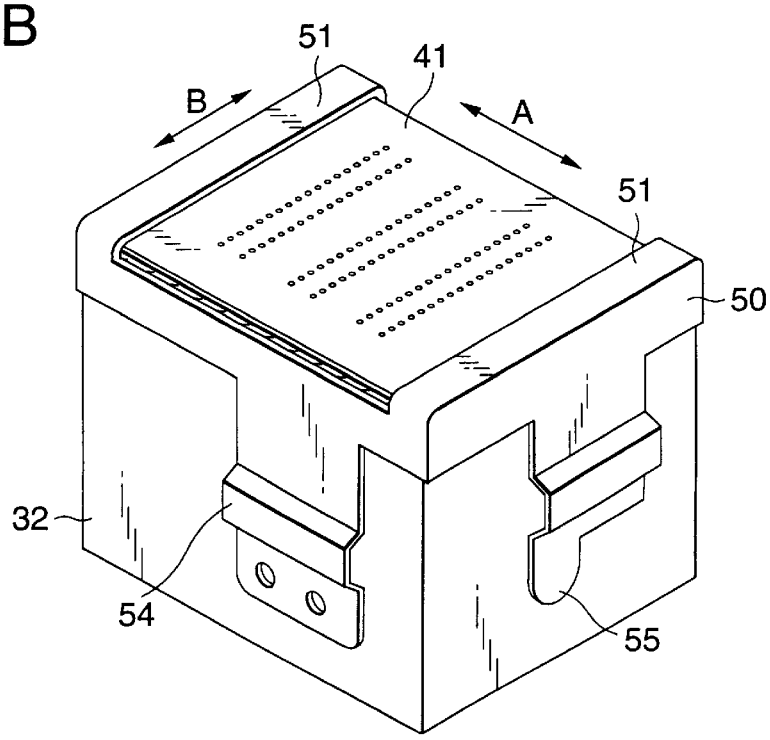

Therefore, for the recording head employing the channel substrate 59 that is formed by anisotropic etching of a silicon monocrystalline substrate, it is preferable that, as is shown in FIG. 8B, the notches 53 of the head cover 35 be formed so as to cover the side faces of the channel forming substrate 59.

With this arrangement, since the wiper blade 56 contacts the smooth end faces of the notches 53 of the head cover 35 in the boundary of the recording head, the abrasion can be prevented preferably.

Figure 9:
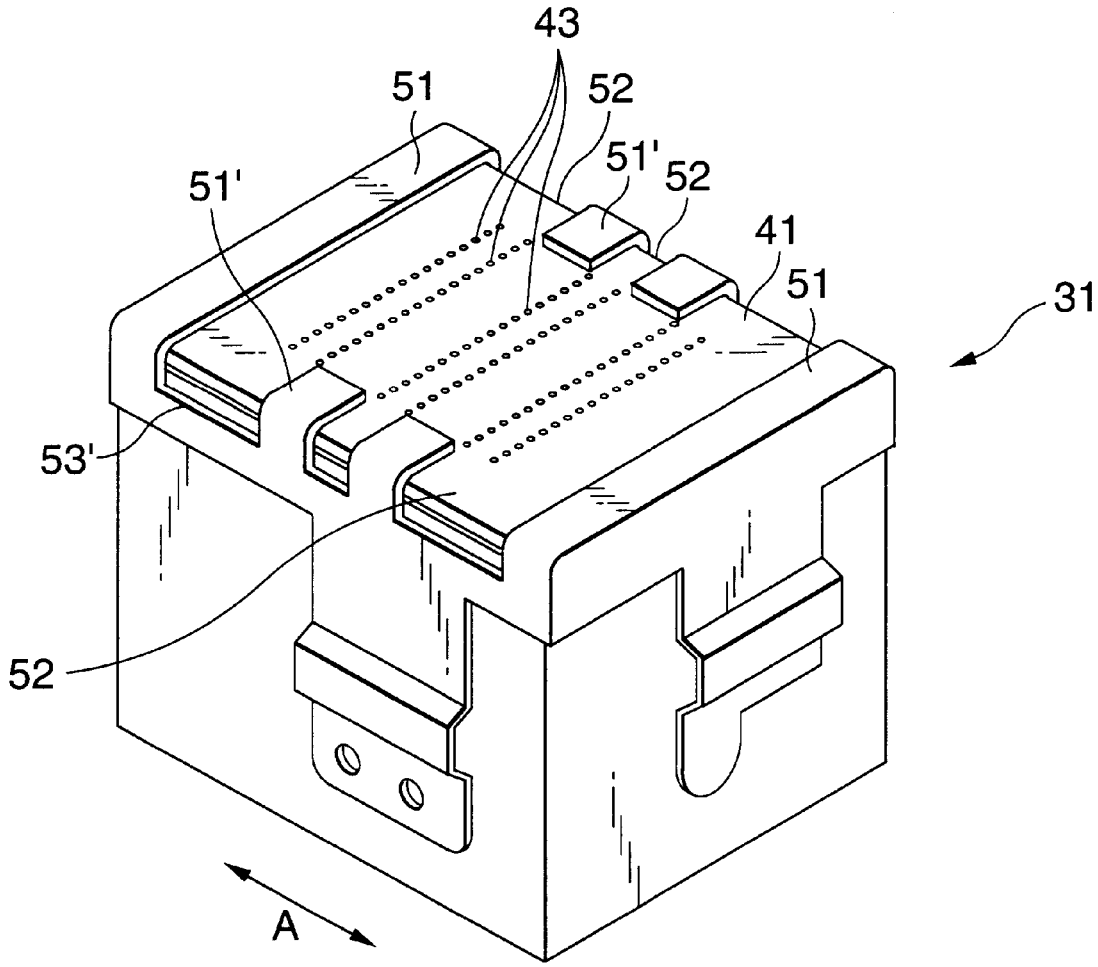
FIG. 9 is a perspective view of a recording head according to a second embodiment of the present invention.

FIG. 9 is a perspective view of a recording head according to a second embodiment of the present invention. A plurality of linear arrays of nozzle orifices 43 are formed in a nozzle plate 41, and notches 53' that are shorter than the notches 53 in the above embodiment are formed on lines extended from the nozzle orifice arrays to define small wiping spaces 52. Further, small overlapping portions 51' are formed at positions outside the lines extended form the nozzle orifice arrays.

According to this embodiment, a wiper blade 56 can be brought into contact with the nozzle orifice arrays in the surface of the nozzle plate 41, without floating, and the overlapping portions 51' can cover and protect the areas of the nozzle plate 41 that are not related to the ink ejection.

Therefore, even when one part of a recording sheet 8 that is bent by paper jamming enters the wiping space 52' and contacts the end of the channel unit 34, pealing of the nozzle plate 41 can be prevented by the overlapping portions 51, and the protection function can be enhanced.

Figure 10:
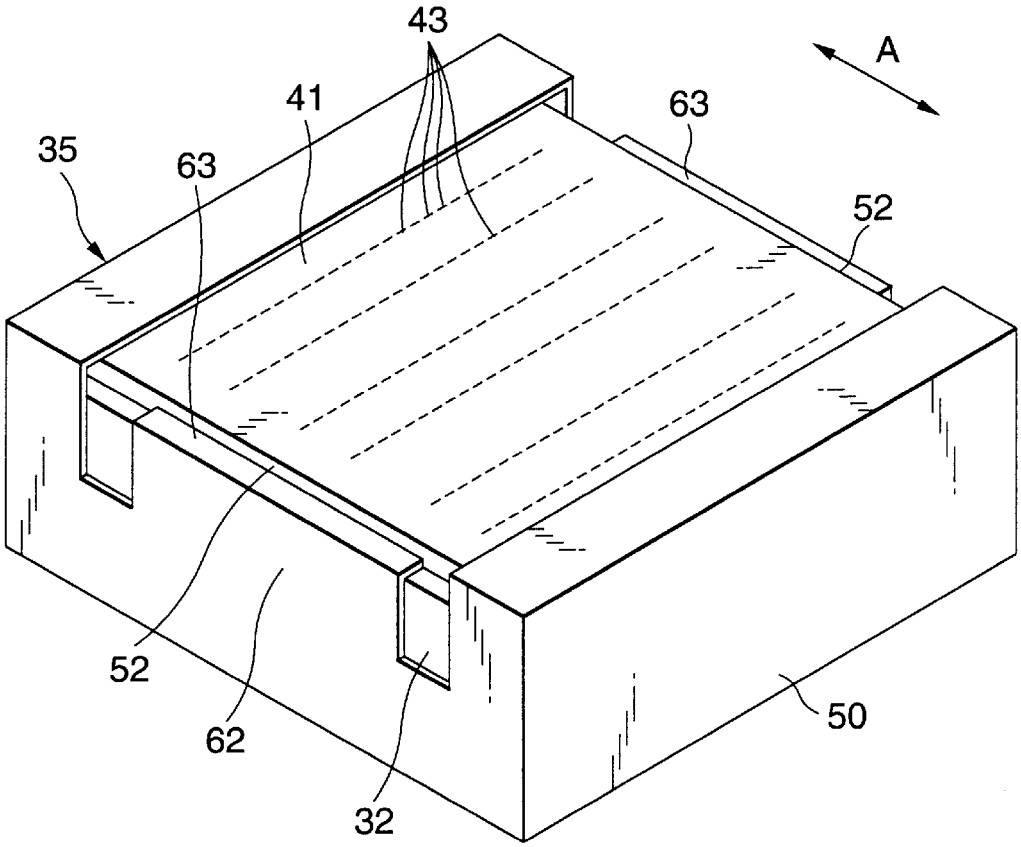
FIG. 10 is a perspective view of a recording head according to a third embodiment of the present invention.

FIG. 10 is a perspective view of a recording head according to a third embodiment of the present invention. In this embodiment, a protection member 62 is provided on sides extending in the wiping direction A integrally with a head cover 35 for covering end faces of a nozzle plate 41 to protect the same. A distal end of the respective protection member 62 may be situated lower than the top surface of the nozzle plate 41 to define a space above the distal end of the respective protection members 62 as a wiping space 52.

According to the above configuration, since the end face portions of a channel unit 34 situated at the side of which the wiping space 52 is defined, damages of the channel unit 34 due to paper jamming can be prevented. By bending the respective distal end portions of the protecting member 62, which is provided along the sides of a casing 32, toward the nozzle plate 41 to form bent portions 63, the stiffness of the head cover 35 can be strengthened.

Figure 11:
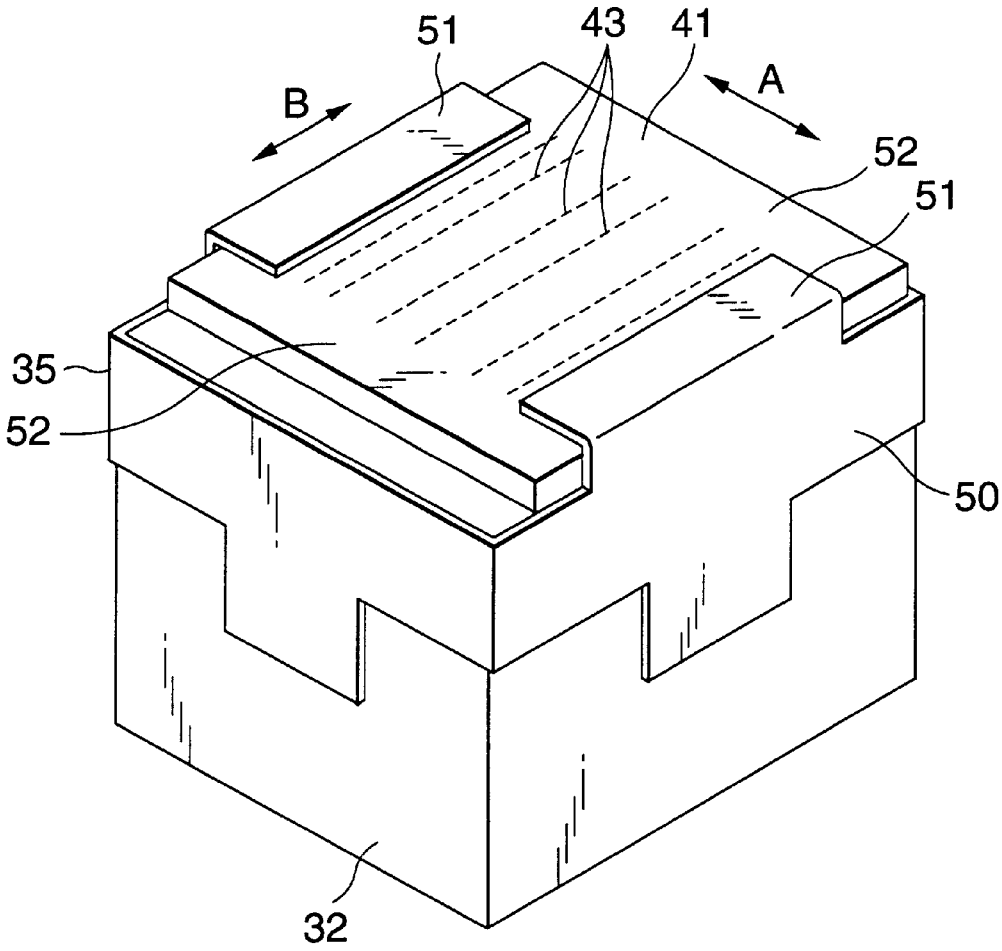
FIG. 11 is a perspective view of a recording head according to a fourth embodiment of the present invention.

In the above embodiment, the head cover 35 is so formed that the overlapping portions 51 cover the four corners of the channel unit 34. However, as in a fourth embodiment of the present invention shown in FIG. 11, overlapping portions that are bent from the side walls 50 along the sides of the casing 32 may be formed on the sides that are extended in direction B perpendicular to relative wiping direction A in order to cover the side edges of the nozzle plate 41, and a wiping space 52 may be defined along the entire length of the sides that are extended in the wiping direction A.

According to this embodiment, since the overlapping portions 51 are formed only on the sides that serve as heads when the head cover 35 is attached, and the other sides are opened by the wiping space 52, the nozzle orifice arrays can be cleaned without the wiper blade 56 floating. And, the overlapping portions 51 can be simplified; for example, the process for narrowing the portions for enclosing the four corners of the channel unit 34 is not required, and the overlapping portions can be formed through simple procedures including a punching process and a bending process.

Figure 12:
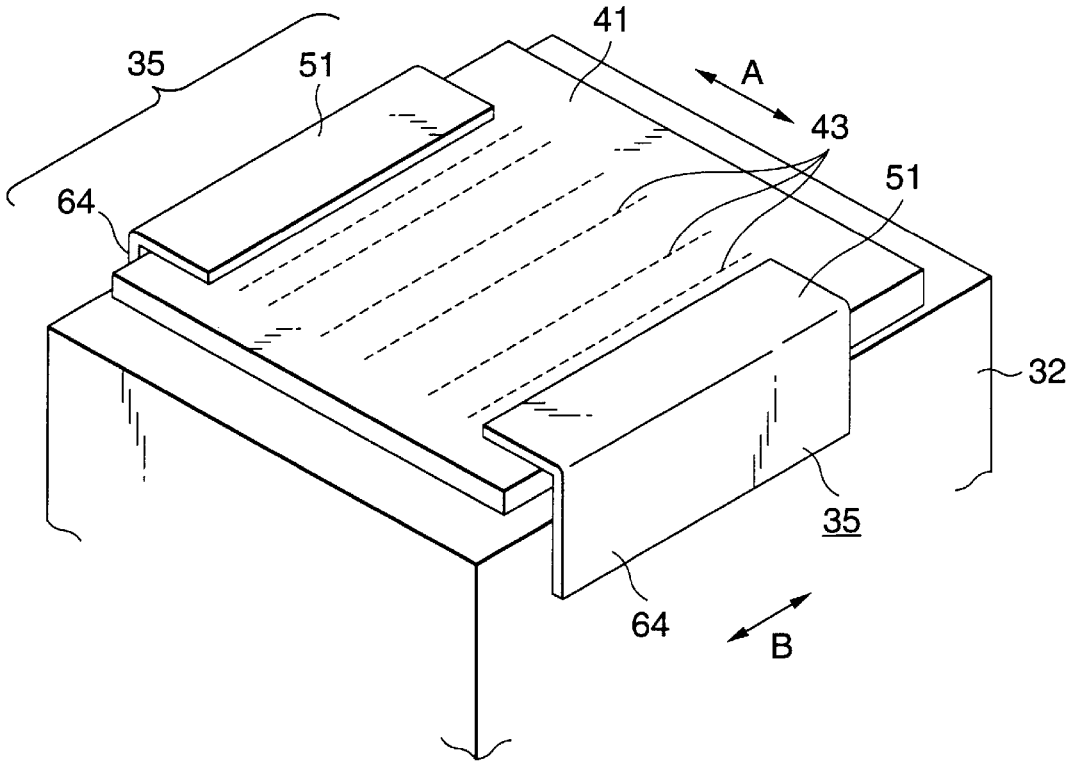
FIG. 12 is a perspective view of a recording head according to a fifth embodiment of the present invention.

In the above embodiments, the head cover 35 is constituted as a single member; however, it can be constituted by separate pieces, as in a fifth embodiment shown in FIG. 12. That is, a bending member having an L shape in cross section is constituted by an overlapping portion 51, which covers the surface of a nozzle plate 41, and a side wall 64, which is bent substantially at 90 degrees from the outer edge of the overlapping portion 51 to the casing 32. The L-shaped members are fixed to the sides of the casing 32 that extend in direction B perpendicular to wiping direction A, i.e., in the direction along the nozzle orifice arrays. Then, both side edges of the nozzle plate 41 are covered with the overlapping portions 51, and the sides in the wiping direction A (the portions located in direction B perpendicular to the nozzle orifice arrays) are opened as the wiping space 52.

According to this example, since only the members having an L-shape in cross section need be fixed, the manufacturing process and the assembly process can be simplified more.

Figure 13:
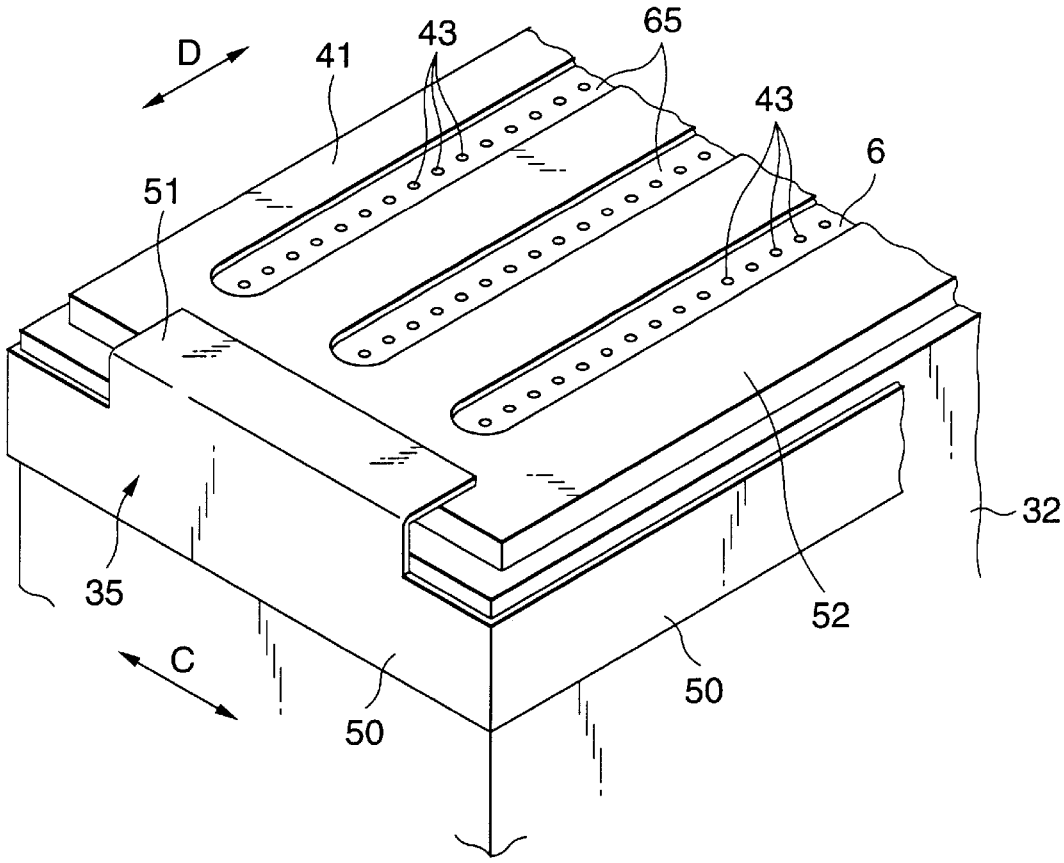
FIG. 13 is a perspective view of a recording head according to a sixth embodiment of the present invention.
Figure 14:
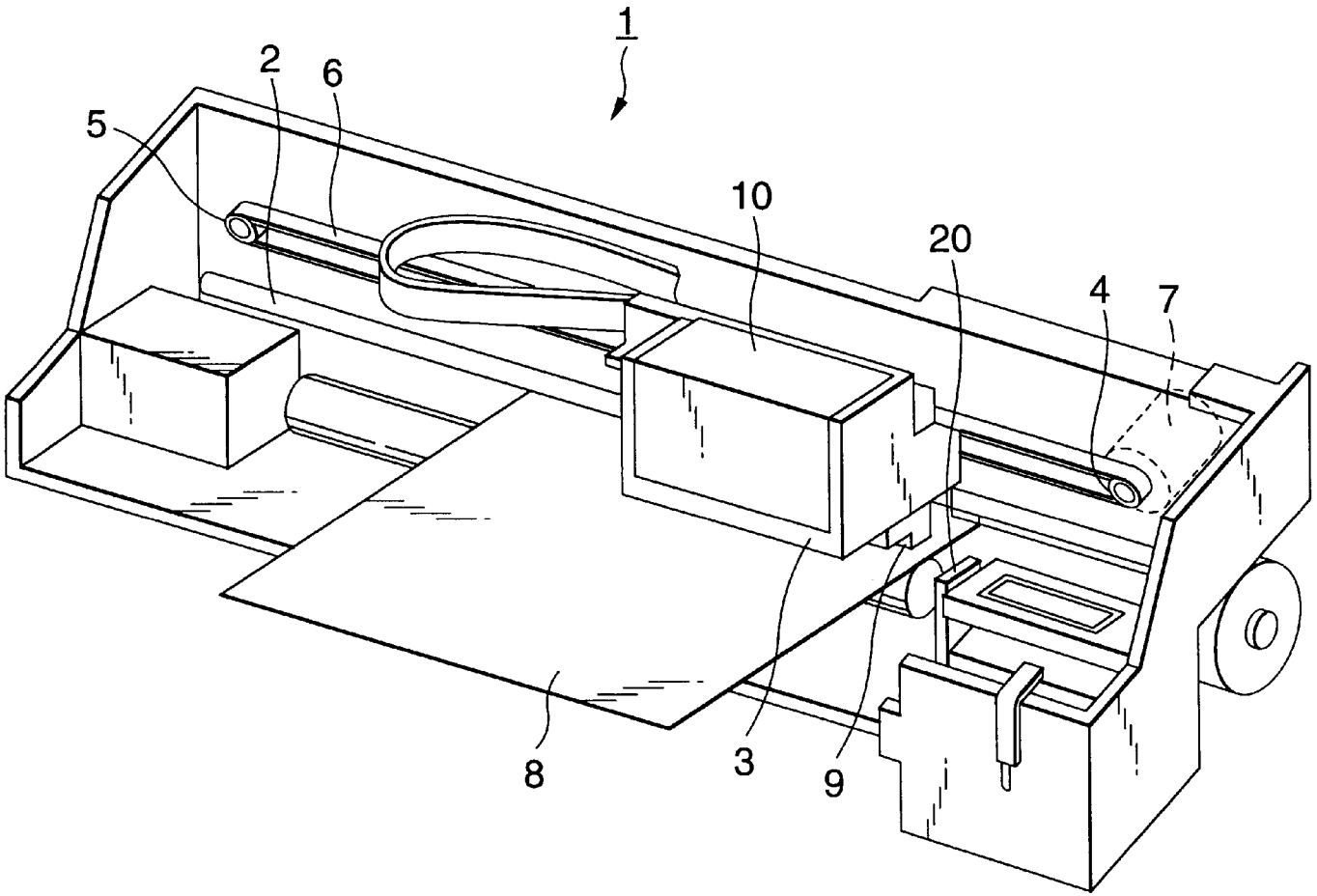
FIG. 14 is a perspective view of the schematic arrangement of an ink-jet recording apparatus.
Figure 15:
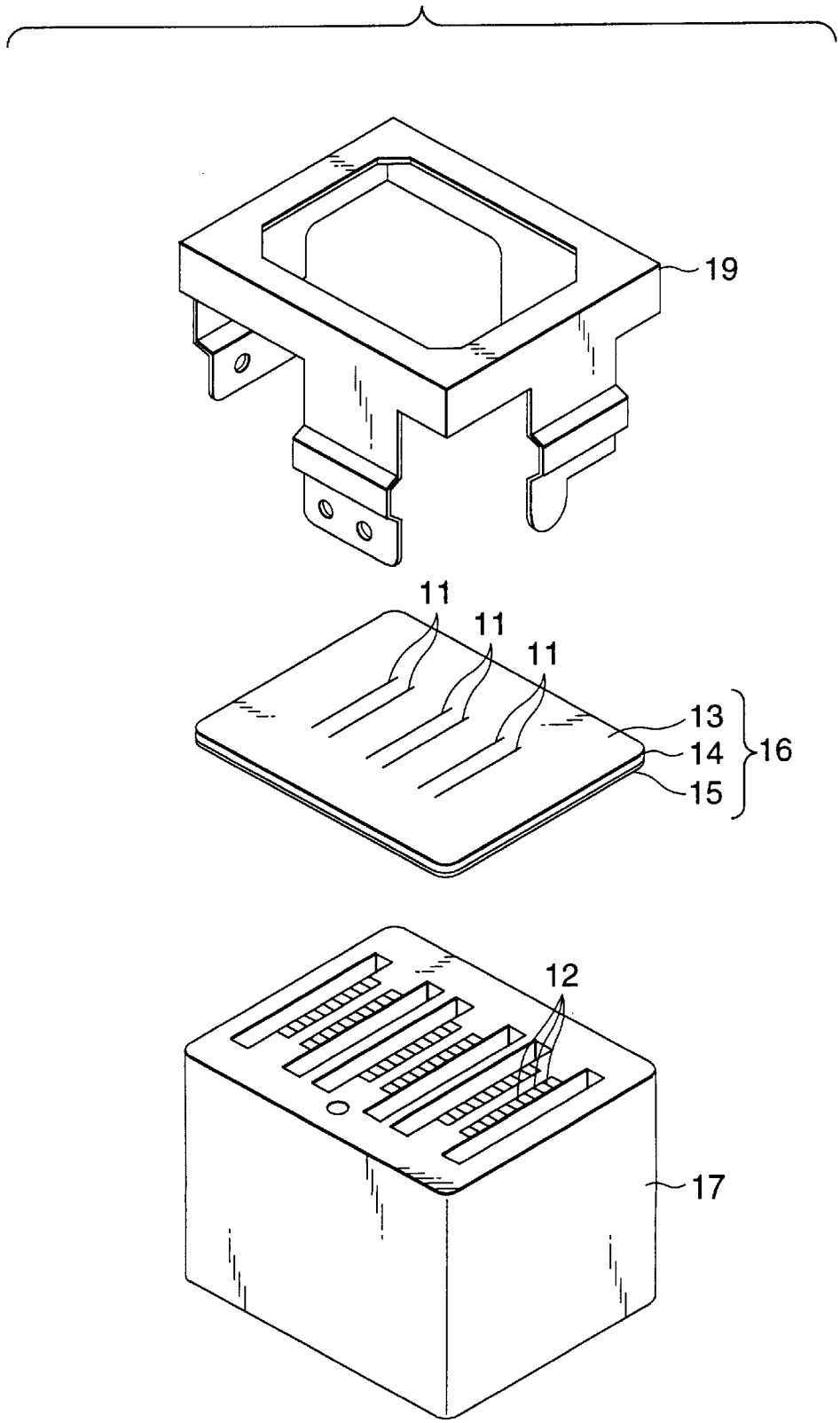
FIG. 15 is an exploded perspective view of a related recording head.

FIG. 13 is a diagram illustrating a sixth embodiment of the present invention. An overlapping portion 51 is formed on the side in direction C in which a recording head 31 is moved; a wiping space 52 is defined on the side that is extended in direction perpendicular to the direction C in which the recording head 31 is moved; and stepped grooves 65 are formed in the surface of a nozzle plate, so that each of the grooves 65 has a bottom in which a nozzle orifice array is formed and the level of which is lower than the surface of the nozzle plate.

In this embodiment, a wiper 20 is moved in direction D in which the nozzle orifice arrays are arranged.

That is, the direction C in which the recording head 31 is moved differs from the wiping direction D, and the nozzle orifice arrays are formed in the wiping direction D. The stepped grooves 65 can be formed by crater plating, and the depth for them need only be several micrometers.

According to this embodiment, the surface of the nozzle plate 41 is cleaned by moving the wiper blade 20 in the nozzle orifice array direction D. Since the ink color is the same in the nozzle orifices 43 of a specific nozzle orifice array, while the ink color differs for the nozzle orifice arrays, mixing of ink colors due to the wiping can be effectively prevented. Further, since the positions of the nozzle orifices 43 are lowered by one step from the location where the distal end of the wiper blade 56 passes, the residual ink removed by the wiper blade 20 is prevented from being forcibly entered in the nozzle orifices 43 to cause clogging. Since the wiping space 52 is ensured when the wiper blade 20 is passed across the nozzle orifices 43, the wiper blade 20 does not float.

In the embodiments shown in FIGS. 1 to 12, a stepped recessed portion such as stepped groove 65 may be formed in the nozzle plate 41, and nozzle orifices 43 may be formed in the bottom of the recessed portion. Thus, the surface process layer in the vicinity of the nozzle orifices 34 can be prevented from being damaged due to paper jamming, and clogging of the nozzle orifices 43 can also be prevented.

Since the slope portions 51 a are formed by tapering the distal edges of the overlapping portions 51, it is possible to reduce the chance at which ink attached to the wiper blade 56 remains at the distal ends of the overlapping portions 51, reduce abrasion of the wiper blade 56, restrict the splashing by the wiper blade 56 and to prevent the dispersion of ink.

In the above embodiments, the piezoelectric vibrators 30 are employed as the pressure generating member. The pressure generating member is not limited to the piezoelectric vibrator, and, for example, a heat generating element may be provided for the pressure generating chambers 45.

As is described above, according to the present invention, since the nozzle orifice forming area, along the side in the longitudinal direction of the wiper blade for wiping the residual ink form the nozzle plate is located closer to the head case than to the nozzle plate so as to obtain the wiping space, the wiper blade can uniformly contact the nozzle plate in the nozzle orifice forming substrate, without the contact face of the wiper blade being bothered by the head cover. As a result, pressing force can be reduced preferably, and the residual ink on the nozzle forming face can be completely removed.

What is claimed is:

1. An ink-jet recording head comprising:

a casing;

a nozzle plate provided on the casing and having a plurality of nozzle orifices formed therein;

a channel forming substrate provided between the nozzle plate and casing for ejecting ink drops from the nozzle orifices by use of a pressure generator and a head cover having side walls which cover side faces of the casing and an overlapping portion which covers edge portions of a top face of the nozzle plate, wherein a wiping space is situated above at least one of said side walls of said head cover.

2. The ink-jet recording head as set forth in claim 1, wherein the head cover is provided on first sides of the nozzle plate which extend in a direction perpendicular to a wiping direction.

3. The ink-jet recording head as set forth in claim 2, wherein the head cover includes overlapping portions for further covering said first sides of the nozzle plate, said overlapping portions extending in a direction perpendicular to the wiping direction, and wherein the overlapping portions extend between the side faces of the casing along a top face of the nozzle plate.

4. The ink-jet recording head as set forth in claim 3, wherein the four corners of the top face of the nozzle plate are covered by the head cover.

5. The ink-jet recording head as set forth in claim 2, wherein a protection member for covering end faces on second sides of the nozzle plate to protect the same are formed integrally with the head cover, and wherein distal ends of the protection member are situated lower than the top face of the nozzle plate to define a wiping space between the distal ends and the top face of the nozzle plate.

6. The ink-jet recording head as set forth in claim 5, wherein the distal end portions of the protection member are bent toward said nozzle plate such that distal ends thereof abut against end faces on the second sides of the nozzle plate to hold the same.

7. The ink-jet recording head as set forth in claim 1, wherein the nozzle orifices are arranged in rows on the top face of the nozzle plate, wherein each row extends in a first direction, and wherein a wiping direction is defined so as to extend in a second direction perpendicular to said first direction.

8. The ink-jet recording head as set forth in claim 1, wherein the head cover includes overlapping portions which cover a first portion of a top surface of said nozzle plate, and wherein said overlapping portions extend in a direction perpendicular to said wiping direction.

9. The ink-jet recording head as set forth in claim 8, wherein said overlapping portions are constructed as separate pieces.

10. The ink-jet recording head as set forth in claim 1, further including recess portions formed on the top face of the nozzle plate such that the nozzle orifices are formed on a bottom thereof.

11. The ink-jet recording head as set forth in claim 1, wherein the nozzle orifices are arranged in rows extending in a wiping direction of the wiper, and groove portions are formed on the top face of the nozzle plate such that the rows of nozzle orifices are formed on respective bottoms thereof.

12. The ink-jet recording head as set forth in claim 1, wherein the head cover is made of a conductive material.

13. The ink-jet recording head as set forth in claim 12, wherein the nozzle plate is grounded through the head cover.

14. The ink-jet recording head as set forth in claim 1, wherein distal end portions of the head cover which cover the edge portions of the top face of the nozzle plate are tapered.

15. The ink-jet recording head as set forth in claim 1, further including a channel unit constituted by the channel forming substrate and the nozzle plate, wherein the channel forming substrate is manufactured by etching anistropically a monocrystalline silicon substrate, and wherein the head cover covers the channel unit.

16. An ink-jet recording head comprising:

a casing;

a channel unit attached to said casing;

a nozzle plate provided on said channel unit, said nozzle plate having a plurality of orifices formed therein arranged in an arrangement direction;

a head cover fixed to said casing, wherein said head cover includes overlapping portions which cover a first portion of a top surface of said nozzle plate, a sidewall covering a side portion of said channel unit; and a notch formed in said sidewall of said head cover, such that said sidewall is positioned at or below said top surface of said nozzle plate in a thickness direction of said nozzle plate.

17. The ink-jet recording head as set forth in claim 16, wherein said notch extends in a direction parallel to a wiping direction and said overlapping portions extend in a direction perpendicular to said wiping direction.

18. The ink-jet recording head as set forth in claim 16, wherein distal edges of said overlapping portions are tapered.

19. The ink-jet recording head as set forth in claim 16, further including a plurality of notches formed in said sidewall of said head cover adjacent to nozzle orifice arrays formed in said nozzle plate.

20. The ink-jet recording head as set forth in claim 19, wherein said sidewall further includes a side overlapping portions which cover a second portion of said top surface of said nozzle plate, said side overlapping portions being positioned between said plurality of notches.

21. The ink-jet recording head as set forth in claim 16, wherein said sidewall includes a protection member which is bent toward the nozzle plate to form bent portions.

22. An ink-jet recording head comprising:

a casing;

a channel unit attached to said casing;

a nozzle plate provided on said channel unit, said nozzle plate having a plurality of orifices formed therein arranged in an arrangement direction;

a head cover fixed to said casing, wherein said head cover includes overlapping portions which cover a first portion of a top surface of said nozzle plate, wherein other portions of said top surface of said nozzle plate are not covered by said head cover.

23. The ink-jet recording head as set forth in claim 22, wherein said overlapping portions extend in a direction perpendicular to said wiping direction.

24. The ink-jet recording head as set forth in claim 22, wherein said overlapping portions are constructed as separate pieces.

25. The ink-jet recording head as set forth in claim 24, further including grooves formed in the surface of said nozzle plate, wherein said nozzle orifices are formed in said grooves.

26. The ink-jet recording head as set forth in any of claims 1 to 8, and 12 to 24, further including grooves formed in the surface of said nozzle plate, wherein said nozzle orifices are formed in said grooves.

27. An ink-jet recording head comprising:

a casing;

a nozzle plate provided on the casing and having a plurality of nozzle orifices formed therein.;

a channel forming substrate provided between the nozzle plate and casing for ejecting ink drops from the nozzle orifices by use of a pressure generator and a head cover which attaches said nozzle plate to said casing, said head cover having side walls which cover side faces of said casing, wherein a wiping space is situated above at least one of said side walls of said head cover.

* * * * *